United States Patent [19]

Poersch et al.

[11] 4,053,364

[45] Oct. 11, 1977

[54] DRYING AND PREHEATING OF MOIST COAL AND QUENCHING OF THE FORMED COKE

[75] Inventors: Werner Poersch, Moers; Martin Wischniewski, Krefeld-Uerdingen; Jakob Essers, Krefeld, all of Germany

[73] Assignee: Buttner-Schilde-Haas Aktiengesellschaft, Krefeld, Germany

[21] Appl. No.: 504,666

[22] Filed: Sept. 9, 1974

[30] Foreign Application Priority Data

Apr. 1, 1974 Germany ..... 2415758

[51] Int. Cl.[2] ..... C10B 39/02; C10B 47/00

[52] U.S. Cl. ..... 201/13; 201/39; 201/43; 202/150; 202/228

[58] Field of Search ..... 201/39, 43, 13–16, 201/28; 202/150, 227, 228, 262, 263

[56] References Cited

U.S. PATENT DOCUMENTS

| | | | |
|---|---|---|---|
| 3,728,230 | 4/1973 | Kemmetmueller | 201/39 |
| 3,843,458 | 10/1974 | Kemmetmueller | 201/39 |

*Primary Examiner*—Wilbur L. Bascomb, Jr.
*Attorney, Agent, or Firm*—Michael J. Striker

[57] ABSTRACT

In a coking installation moist coal to be converted into coke is dried and preheated by being contacted by a hot drying gas. The hot coke which is formed is subjected to a dry quenching in which at least a portion of the heat lost by the hot coke during the drying quenching thereof is imparted to the drying gas. There is provided a closed flow circuit for the continual recirculation of a body of drying gas. The closed flow circuit includes a portion in which the drying gas comes into contact with moist coal which is to be dried and preheated. When the drying gas comes into contact with the moist coal water vapor becomes mixed with the drying gas. The water vapor is removed from the drying gas by means of condensation.

19 Claims, 2 Drawing Figures

DRYING AND PREHEATING OF MOIST COAL AND QUENCHING OF THE FORMED COKE

BACKGROUND OF THE INVENTION

The invention relates in general to the drying and preheating of moist coal and the dry quenching of coke. More particularly, the invention relates to the combination of apparatus for dry quenching hot coke and to apparatus for the continuous drying and preheating of coal utilizing heat imparted by the glowing coke to the quenching gas, with a closed flow circuit for the quenching gas and with a flow path for drying gas passing through a drying and heating arrangement for the coal which is to be converted into coke.

An arrangement of this general type is disclosed in West German Offenlegungsschrift No. 2,304,541. The known arrangement continuously sucks in carburated gas to be employed as the drying gas. The gas is passed through a heat exchanger and brought to the required temperature by means of indirect heat exchange with the hot quenching gas and, after passage through the coal drier, freed of dust and then discharged. The drying gas must be an inert gas, i.e., in particular a gas which is low in oxygen, so as to avoid undesired reactions during the heating of the coal. Use is preferably made of nitrogen. However, the use of nitrogen is a quite expensive expedient. The fact that the quantity of gas to be freed of dust is very large leads to the incurrence of additional expense.

West German Offenlegungsschrift No. 2,304,541 additionally discloses a second arrangement of the general type in question. This second arrangement makes use of a single closed gas flow circuit passing through both the quenching bunker and through the coal drier. In this arrangement, the quenching gas also serves as the drying and heating medium for the starting material. Operation of such an arrangement is characterized by many practical disadvantages and difficulties. The circulating gas stream, containing substantially all the water vapor developed in the coal drier, enters the quenching bunker and upon contacting the hot coke in the quenching bunker forms water gas in considerable amounts. On the one hand, the water gas reaction results in a considerable furnace loss of the coke and, on the other hand, the highly explosive water gas creates very serious safety problems.

Another coal drying method of the general type in question is disclosed in West German Auslegeschrift No. 1,187,584. With this method, the heat generated during the quenching is not utilized for heating the drying gas. The drying gas travels through a flow path. A part of the gas, specifically as much as corresponds to the increase of the total gas quantity due to the addition of water vapors in the coal drier, is discharged into the free atmosphere. The drying gas, after a certain start-up period, becomes composed almost exclusively of superheated steam. With this method, avoiding condensation constitutes a serious problem, since such condensation creates the possibility of damage due to corrosion and during operation can lead to pressure fluctuations which are difficult to control.

SUMMARY OF THE INVENTION

It is a general object of the invention to provide a method and arrangement of the general type in question but not characterized by the disadvantages of the prior art.

It is a more particular object to provide a method and arrangement characterized by low consumption of energy and by low cost in general according to which the discharge of gas and thus the detrimental effect upon the environment is kept as small as possible.

It is a further object of the invention to preclude the difficulties and risks inherent in methods and apparatuses of the type which cause large amounts of water vapor to be generated during the drying of the coal.

This object, and others which will become more understandable from the description, below, of preferred embodiments, can be met, according to one advantageous concept of the invention, by providing, in a coking installation of the type in which moist coal to be converted into coke is dried and preheated by being contacted by a hot drying gas and in which the hot coke which is formed is subjected to a dry quenching and in which at least a portion of the heat lost by the hot coke during the drying quenching thereof is imparted to the drying gas, in combination, gas-conducting means defining a closed flow circuit for the continual recirculation of a body of drying gas, said closed flow circuit including a portion in which the drying gas comes into contact with moist coal which is to be dried and preheated; and condensing means for removing from the drying gas water vapor which becomes mixed with the drying gas when the drying gas comes into contact with the moist coal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
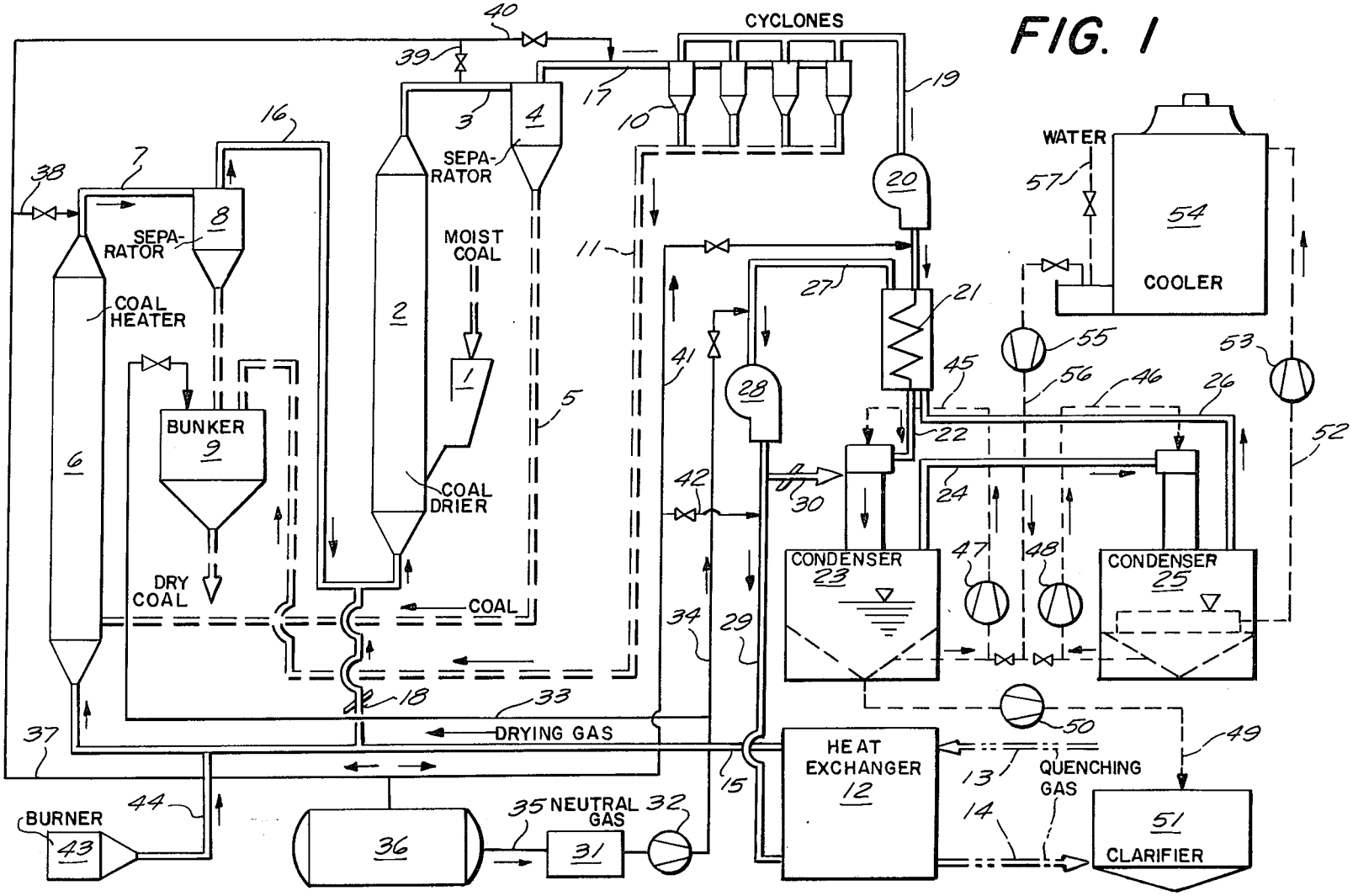
FIG. 1 depicts a first exemplary embodiment of the invention.

The embodiment of FIG. 1 will be described first.

Moist coal is filled into the feed hopper 1 of the coal drier. The coal drier has the form of a stream pipe 2. Dried coal carried by the stream of drying gas leaves the stream pipe 2 through a conduit 3 and enters a separator 4, and then travels through gravity pipe 5 to the stream pipe 6, which latter serves for the heating of the now dry coal. The path of the coal, whose temperature by this point of its travel is about 260° C, further includes a conduit 7 leading into a separator 8 which in turn leads into a finished-product bunker 9. Also leading into the finished-product bunker 9 is a conduit 11 which conveys the fine particulate matter discharged at the outlets of dust removers 10. From the bunker 9 the coal is transported to the non-illustrated coking oven.

The embodiment of FIG. 1 furthermore includes a heat exchanger 12 comprised of means defining a primary flow path and a secondary flow path. The hotter medium flows through the primary flow path, whereas the cooler medium flows through the secondary flow path. The primary flow path of the heat exchanger 12 forms part of the circuit for the quenching gas. The quenching gas flows through a closed circuit. This circuit is comprised of the quenching bunker, where the quenching gas is heated to a temperature of 750° C to 800° C, possibly the heat exchanger of a steam generator, and the heat exchanger 12. From the heat exchanger 12 the quenching gas is conveyed back into the quenching bunker. For the sake of clarity, the circuit for the quenching gas, which is per se known, is depicted only to the extent of the heat exchanger 12 and the quenching gas inlet 13 and outlet 14.

The secondary flow path of the heat exchanger 12 carries the drying gas, which flows through the secondary flow path in counterflow to the quenching gas.

The heated drying gas leaves the heat exchanger 12 through a conduit 15 at a temperature between 500° and 600° C and is conveyed first to the stream pipe 6 wherein it imparts a portion of its heat to the coal in pipe 6. The drying gas travels further through the outlet conduit 7, through the separator 8 and through the conduit 16, entering the stream pipe 2. The temperature of the drying gas is between about 300° C and about 350° C as it enters the stream pipe 2 and about 100° C as it leaves the stream pipe 2.

Arranged in parallel to the stream pipe 6 and discharging into the conduit 16 there is connected a conduit 18 provided with an adjustable flow restrictor. The conduit 18 accordingly connects the outlet of the heat exchanger 12 directly to the inlet of the stream pipe 2.

The drying gas streaming through conduit 16 and already somewhat cooled down is supplemented by the addition, through conduit 18, of an amount of hotter drying gas increasing in correspondence to the dampness of the starting material, as a result of which an increased quantity of gas of higher temperature is available when necessary for the drying process which takes place in the stream pipe 2. The rate at which additional hotter drying gas from conduit 15 is fed through conduit 18 and mixed with the somewhat cooler drying gas in conduit 16 is controlled manually or by means of an automatically operating regulator, but in such a manner that the moisture content of the coal leaving the stream pipe 2 always has the same preselected value, independent of the initial moisture content of the coal.

The circuit for the drying gas is further comprised of an outlet conduit 3 leading out from the stream pipe 2 to the separator 4, a conduit 17 leading out from the separator 4 into dust removers 10, a conduit 19 leading into a ventilator 20, with the outlet of the ventilator 20 leading into a heat exchanger 21 in which the drying gas is cooled down further. The cooled-down drying and heating gas is conveyed through conduit 22 into an injector condenser 23 in which the water vapor contained in the drying gas is brought to saturation and partially caused to condense and in which, additionally, extremely fine dust particles are separated out. A conduit 24 connects the first injector condenser 23 to a second injector condenser 25 into which the drying gas enters. In the condenser 25 the remaining water vapor is caused to condense and is removed from the stream of drying gas. This operation is likewise characterized by a certain amount of dust removal. From the condenser 25, the drying gas, now purified, cooled down and saturated at a low temperature, is conveyed through conduit 26 into the secondary flow path of heat exchanger 21 and there brought into heat-exchanging relationship with and preheated by the drying gas from which the water vapor has not yet been removed.

The drying gas, after passing through the secondary flow path of heat exchanger 21, emerges from the outlet thereof, travels through the conduit 27 and passes through the ventilator 28. From the ventilator 28 it passes through the conduit 29 and then flows, once again, through the secondary flow path of the heat exchanger 12.

Thus, the drying gas in the steady state flows around a complete closed circuit. However, in the event that, for example, a small additional quantity of gas enters into the drying-gas circuit through the feed hopper 1 or through the finished-product bunker 9, or if small quantities of gas are released from the hot coal, the excess gas can escape through an outlet conduit 30. The outlet conduit 30 is provided with a throttle valve controlled in dependence upon pressure.

It will be appreciated that a considerable advantage of this arrangement is that the drying gas, for example comprised principally of nitrogen, is present in the form of a continually recirculated body of gas, in contrast to the prior-art expedients according to which the drying gas is used only once and then discharged into the atmosphere.

It is conceivable that atmospheric air could penetrate into the arrangement as a result of imperfections in the seal-tightness of the arrangement. To prevent this, the gas pressures employed in the arrangement are preferably all superatmospheric. In the steady state, the replenishment of the circulating drying gas is necessary only to compensate for gas leakage losses. To this end, there is provided an inert gas generator 31. Connected to the outlet of gas generator 31 is the inlet of a pump 32. Connected to the outlet of pump 32 are two direct conduits 33 and 34, of which one discharges into the finished-product bunker 9 and the other into conduit 27 between the outlet of the secondary flow path of heat exchanger 21 and the ventilator 28. Additionally, the protective gas generator 31 is connected by means of a conduit 35 with a supply tank 36. Connected to an outlet of the supply tank 36 is a conduit 37 having three branches 38, 39 and 40. These respectively discharge into the sections 7, 3 and 18 of the drying gas flow path.

A further conduit 41 connected to the outlet of the supply tank 36 discharges between the ventilator 20 and the inlet of the primary flow path of the heat exchanger 21. A conduit 42 branches off from conduit 41 and discharges into the conduit 29 intermediate the ventilator 28 and the inlet of the primary flow path of the heat exchanger 12. The valves which serve to connect the conduits 38, 39, 40, 41, 42 to the drying-gas circuit are normally closed. They are opened only in the event of a sudden leakage break-in. Accordingly, the penetration of large quantities of air into the drying-gas circuit is prevented and thus the concomitant danger of explosion precluded.

The burner 43 operates only during the start-up. The combustion gases pass through conduit 44 and enter into the drying-gas circuit, displacing the air which initially occupies the circuit. During this start-up phase, the outlet conduit 30 is open. Only when the oxygen content has fallen below a preselected value is the feeding of coal initiated.

Each of the injector condensers 23 and 25 is connected into a respective one of the water recirculation circuits 45, 46, which respectively further include pumps 47, 48. A part of the slurry which accumulates in the condenser 23 is passed out of condenser 23 through conduit 49 by means of a pump 50 and pumped by the latter into a settling tank 51.

Water from condenser 25 is pumped out through a conduit 52 by a pump 53 and into a cooling tower 54. The pumped off quantity of water includes water which was driven out of the coal and condensed in the condenser 25. From the collector tank of the cooling tower 54 cooled water in the form of fresh water is pumped by the pump 55 through the conduit 56 back into the water recirculation circuits 45, 46 of the condensers 23, 25, with the water level in the condensers 23, 25 being maintained essentially constant. The fresh water in the collector tank of the cooling tower 54 is replenished through a conduit 57.

Figure 2:
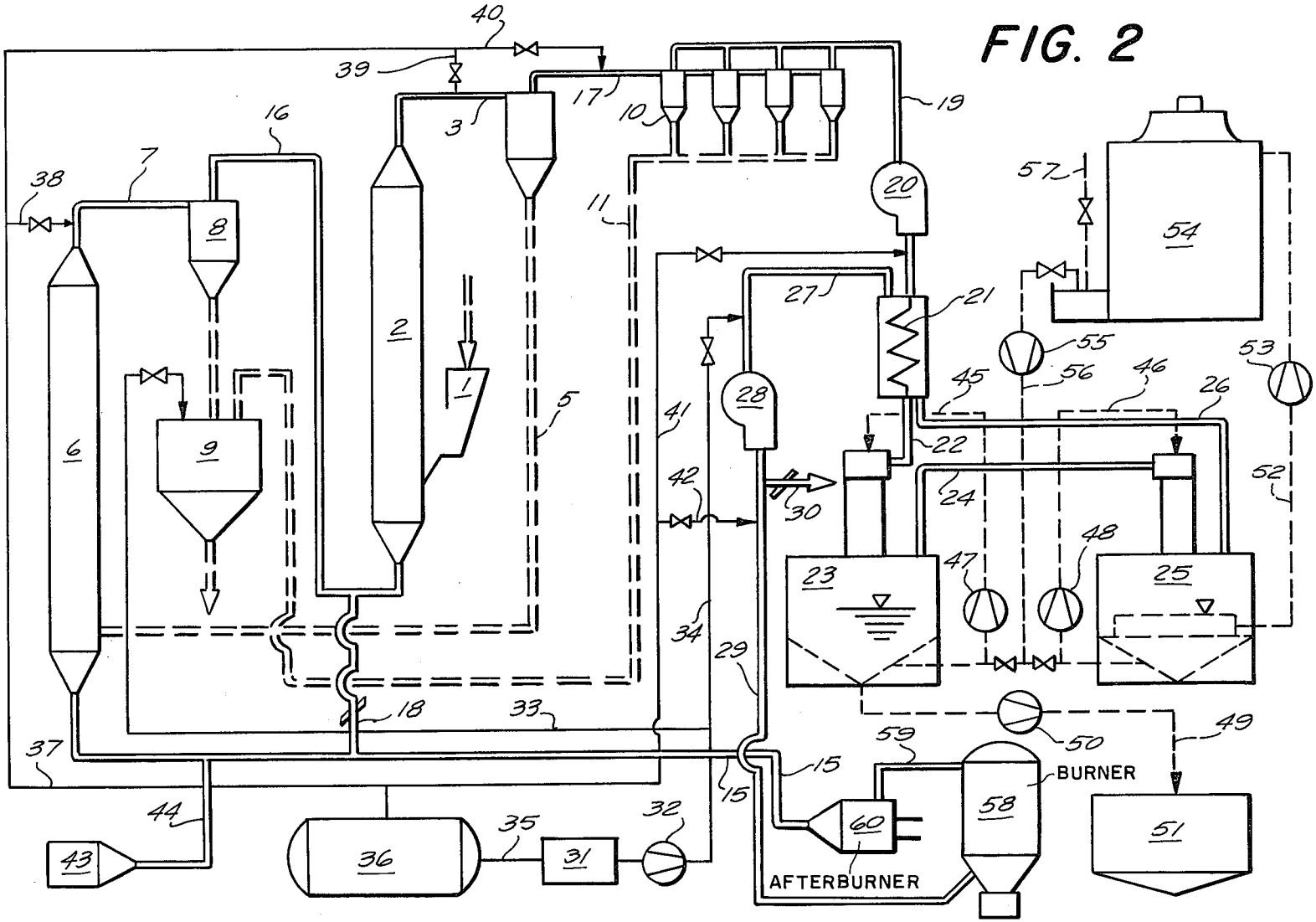
FIG. 2 depicts a second exemplary embodiment of the invention.

In the embodiment of FIG. 2, the quenching gas circuit is combined with the drying gas circuit to form a single circuit. Drying gas, after it has passed through the condensers 23, 25 and been substantially completely freed of moisture, and after it has passed through the secondary flow path of the heat exchanger 21, is fed through the conduit 29 as a relatively cold gas directly to the quenching bunker 58. In passing through the quenching bunker the gas is warmed on the hot coke to 750°–800° C. Upon contacting the glowing coke water gas is formed in correspondence to the residual water vapor content.

Self-evidently, the water gas content must not be permitted to reach a value in the explosive range in any part of the gas circuit. To this end, it may be necessary to make the condenser arrangements 23, 25 of somewhat larger dimensions, in order to still further reduce the temperature and therefore also the saturated water vapor content of the gas prior to the entry of the gas into the quenching bunker 58, for example to reduce the temperature of the gas down to 30° C.

The gas stream leaving the quenching bunker 58 is fed through a conduit 59 into the combustion chamber of an auxilliary burner 60 which is charged with supplemental combustible material, this chamber serving as an afterburner chamber. Water gas which is generated in the quenching bunker 58 despite the provision of the condensers 23 and 25, is completely oxidized in the afterburner 60. In this way, continual enrichment of the circulating gas stream with water gas is precluded. From the auxiliary burner 60 the gas passes into conduit 15. The travel of the gas between the conduit 15 and the conduit 29 corresponds to what has been described with reference to FIG. 1.

In the embodiment of FIG. 2, in contrast to that of FIG. 1, during the operation of the illustrated arrangement, gas is continually fed into the gas circuit, although only at a relatively low rate, the gas consisting of the combustion products of the auxiliary burner 60. In this way, the inert atmosphere is continually renewed. Quantities of gas corresponding to those entering the circuit must of course leave the circuit, through the outlet conduit 30.

The endothermic water gas reaction contributes to the cooling of the coke in the quenching bunker. Additionally, the drying and heating process is benefited by the heat generated in the auxiliary burner from the supplementally provided combustible material and the water gas. In this way there is achieved some degree of compensation for the unavoidable diminution of the coke due to furnace losses.

Use can additionally be made of, for example, a non-illustrated heat exchanger connected in the conduit 59 intermediate the quenching bunker 58 and the auxiliary burner 60, in order to draw any excess heat out from the circulating gas and to make use of such heat for some other purpose.

The embodiment of FIG. 2 has the advantage that the relatively expensive heat exchanger connected between the quenching gas circuit and the drying gas circuit is dispensed with, thereby eliminating the problem of the encrustation of the heat-exchanging surfaces of the heat exchanger, which may arise in certain circumstances.

In the embodiments of both FIGS. 1 and 2, the provision of the second heat exchanger 21 is particularly advantageous. On the one hand, the continually recirculating drying and preheating gas is precooled prior to its passage through the condensing arrangements, so that the condensing arrangements can be of smaller dimensions than otherwise possible. In addition, the gas leaving the condensing arrangements, saturated at a relatively low temperature, is preheated during its passage through the secondary flow path of the heat exchanger 21, so that its moisture content now falls below the new saturation level, thereby avoiding to a great extent the possibility of the condensation of any residual water vapor in this part of the drying gas flow circuit.

In the embodiments of both FIGS. 1 and 2, it is advantageous to dry and preheat the moist coal in two separate chambers, namely the drying chamber 2 and the preheating chamber 6. Drying of the moist coal in a separate drying chamber makes it possible to separately take into account the considerable variations of the moisture content of the moist coal fed into the hopper 1. Thus, it becomes possible to ensure that the moisture content of the dried coal fed to the preheating chamber 6 will be always be substantially the same, i.e., as though the initial moisture content of the moist coal fed into the hopper 1 always had the same minimum value. In particular, the provision of the bypass conduit 18, for the purpose of mixing to a variable extent hotter drying gas with the cooler drying gas entering drying chamber 2, makes it possible to compensate for fluctuations in the initial moisture content of the moist coal and to thereby keep relatively low any fluctuations in the flow of drying gas. To this end, it would for example be possible to provide automatic moisture-content-sensing means of per se known construction, to sense the moisture content of the moist coal entering drier 2 and to adjust the flow of hotter drying gas through bypass conduit 18 in automatic dependence upon the detected moisture content, to compensate for variations in such initial moisture content.

In the embodiments of FIGS. 1 and 2, the provision of the supply tank 36 and of the inert gas generator 31 is advantageous, because it facilitates the start-up of the combined drying, preheating and quenching arrangement, during which the air or other gas initially present in the drying gas flow circuit must be displaced, and also because it makes possible the easy compensation of small losses of drying gas attributable to leakage. In addition, in the event of the sudden development of a serious break in the sealtightness of the drying gas flow circuit, considerable quantities of inert gas can be pumped into the drying gas flow circuit at high pressure, to prevent the entrance of atmospheric oxygen into the gas flow circuit.

It will be understood that each of the elements described above, or two or more together, may also find a useful application in other types of constructions differing from the types described above.

While the invention has been illustrated and described as embodied in a method and arrangement for drying moist coal, preheating the dried coal prior to the conversion of the coal into coke and quenching the formed coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended:

1. A method of treating coal and coke comprising the steps of: continuously circulating a drying gas in a closed flow circuit past a heating station, a preheating station downstream of said heating station, a drying station downstream of said preheating station, and a condensing station downstream of said drying station and upstream of said heating station; dry quenching freshly formed coke and imparting heat therefrom to said drying gas at said heating station; directly contacting moist coal with said drying gas at said drying station to at least partially dry said coal and drive water therefrom as water vapor into said drying gas; transporting the dried coal from said drying station to said preheating station; directly contacting said dried coal at said preheating station with said drying gas to heat said coal; condensing the water vapor in said drying gas at said condensing station thereby removing at least some of said water vapor from said drying gas.

2. The method defined in claim 1 wherein said coke is dry quenched by passing a quenching gas in a second closed flow circuit distinct from the first-mentioned flow circuit directly over said coke, whereby heat from said coke is picked up by said quenching gas, said heat being imparted to said drying gas by conductively juxtaposing said circuits without mingling of the gases thereof in a heat exchanger at said heating station.

3. The method defined in claim 1 wherein said heat is imparted to said drying gas by circulating said drying gas directly over said freshly formed coke.

4. A coking installation comprising: means for continuously circulating a drying gas in a closed flow circuit past a heating station, a preheating station, a drying station, and a condensing station; means at said heating station for dry quenching freshly formed coke and imparting heat therefrom to said drying gas; means at said drying station for directly contacting moist coal with said drying gas to at least partially dry said coal and drive water therefrom as water vapor into said drying gas; means at said preheating station for directly contacting the dried coal with said drying gas to heat same; and condensing means at said condensing station for continuously removing from said drying gas at least some of said water vapor by condensing such water vapor.

5. The installation defined in claim 4 wherein said means at said heating station includes means for circulating a quenching gas in a second closed flow circuit distinct from the first-mentioned closed flow circuit directly over said freshly formed coke and a heat exchanger through which both of said gases pass for heat exchange therebetween.

6. The installation defined in claim 5 wherein said condensing means at said condensing station includes at least one injector condenser.

7. The installation defined in claim 6 wherein said condensing means at said condensing station includes two such injector condensers connected in series with each other.

8. The installation defined in claim 5 wherein said condensing means at said condensing station includes a condenser connected in and forming part of said first closed flow circuit, said heat exchanger constituting a first heat exchanger and a second heat exchanger, the latter having a primary flow path connected in and forming part of said first closed circuit upstream of said condenser and a secondary flow path connected in and forming part of said first closed circuit downstream of said condenser and upstream of said first heat exchanger.

9. The installation defined in claim 3, further comprising means for supplying inert gas into said first closed flow circuit during start-up of the drying and preheating operation and for the purpose of compensating for gas leakage losses.

10. The installation defined in claim 4 wherein said means at said heating station includes means for passing said drying gas as a quenching gas directly over said freshly formed coke, whereby said drying gas also serves to quench said coke and automatically picks up the heat from said coke as it passes thereover.

11. The installation defined in claim 10 wherein said condensing station is upstream of said heating station, whereby the formation of water gas at said heating station as a result of contact between hot coke and humid gas is largely avoided.

12. The installation defined in claim 11, further means immediately downstream in said circuit from said heating station and including an afterburner for oxidizing combustible constituents of said drying gas.

13. The installation defined in claim 10 wherein said condensing means at said condensing station comprises at least one injector condenser.

14. The installation defined in claim 13 wherein said condensing means at said condensing station comprises two such injector condensers connected in series.

15. The installation defined in claim 10 wherein said condensing means at said condensing station comprises a condenser connected in and forming part of said closed flow circuit and a heat exchanger having a primary flow path connected in and forming part of said closed flow circuit upstream of said condenser and a secondary flow path connected in and forming part of said closed flow circuit downstream of said condenser.

16. The installation defined in claim 4 wherein said condensing means at said condensing station comprises a condenser connected in and forming part of said closed flow circuit, said installation further comprising a heat exchanger having a primary flow path connected in and forming part of said closed flow circuit upstream of said condenser and a second flow path connected in and forming part of said closed flow circuit downstream of said condenser.

17. The installation defined in claim 4 wherein said preheating station is downstream of said heating station, said drying station is downstream of said preheating station, and said condensing station is downstream of said drying station and upstream of said heating station, said installation further comprising means for transporting the dried coal from said drying station to said preheating station.

18. A coking installation comprising: means for continuously circulating a drying gas in a first closed flow circuit past a heating station, a preheating station, a drying station, and a condensing station; means at said heating station for dry quenching freshly formed coke and imparting heat therefrom to said drying gas, said means at said heating station including means for circulating a quenching gas in a second closed flow circuit distinct from said first closed flow circuit directly over said freshly formed coke and a heat exchanger through which both of said gases pass for heat exchange therebetween; means at said drying station for directly contacting moist coal with said drying gas to at least partially dry said coal and drive water therefrom as water vapor into said drying gas; means at said preheating station for directly contacting the dried coal with said drying gas to heat same; means at said condensing station for removing from said drying gas at least some of said water vapor, means for transporting the dried coal from said drying station to said preheating station; a regulating conduit connected in parallel with said circuit across said preheating station and having a downstream end opening into said circuit just upstream of said drying station; and means for controlling the quantity of drying gas which bypasses said preheating station through said regulating conduit, whereby the drying action at said drying station is increased to ensure that the dried coal conveyed to said preheating station will always have substantially the same moisture content regardless of the moisture content of the coal prior to drying in said drying station.

19. A coking installation comprising: means for continuously circulating a drying gas in a closed flow circuit past a heating station, a preheating station, a drying station, and a condensing station; means at said heating station for dry quenching freshly formed coke and imparting heat therefrom to said drying gas, said means at said heating station including means for passing said drying gas as a quenching gas directly over said freshly formed coke, whereby said drying gas also serves to quench said coke and automatically picks up the heat from said coke as it passes thereover; means at said drying station for directly contacting moist coal with said drying gas to at least partially dry said coal and drive water therefrom as water vapor into said drying gas; means at said preheating station for directly contacting the dried coal with said drying gas to heat same; means at said condensing station for removing from said drying gas at least some of said water vapor; means for transporting the dried coal from said drying station to said preheating station; a regulating conduit connected in parallel with said circuit across said preheating station and having a downstream end opening into said circuit just upstream of said drying station; and means for controlling the quantity of drying gas which bypasses said preheating station through said regulating conduit, whereby the drying action at said drying station is increased to ensure that the dried coal conveyed to said preheating station will always have substantially the same moisture content regardless of the moisture content of the coal prior to drying in said drying station.

* * * * *